United States Patent [19]

Begitschke et al.

[11] Patent Number: 4,904,198

[45] Date of Patent: Feb. 27, 1990

[54] VIBRATION-PROOF PLUG AND SOCKET

[75] Inventors: Bruce A. Begitschke, Sylvania; David B. Potter, Toledo, both of Ohio

[73] Assignee: Rowe Industries, Inc., Toledo, Ohio

[21] Appl. No.: 265,329

[22] Filed: Oct. 27, 1988

Related U.S. Application Data

[63] Continuation of Ser. No. 101,684, Sep. 28, 1987, abandoned.

[51] Int. Cl.[4] ..... H01R 13/52

[52] U.S. Cl. ..... 439/281; 439/278; 439/184

[58] Field of Search ..... 439/276, 278, 281, 283, 439/312, 588, 604, 592, 589, 548, 549

[56] References Cited

U.S. PATENT DOCUMENTS

| | | | |
|---|---|---|---|
| 3,143,384 | 8/1964 | Senior, Jr. | 439/282 |
| 3,199,060 | 8/1965 | Marasco | 439/282 |
| 3,601,761 | 8/1971 | Harris | 439/281 |
| 3,611,255 | 10/1971 | Shroyer | 439/282 |
| 3,867,001 | 2/1975 | Hedman | 439/281 |
| 3,953,099 | 4/1976 | Wilson | 439/281 |
| 3,994,553 | 11/1976 | Kornick | 439/281 |
| 4,090,759 | 5/1978 | Herrmann, Jr. | 439/281 |
| 4,166,664 | 9/1979 | Herrmann, Jr. | 439/281 |
| 4,214,802 | 7/1980 | Otani et al. | 439/281 |
| 4,498,719 | 2/1985 | Juris et al. | 439/278 |

FOREIGN PATENT DOCUMENTS

| | | | |
|---|---|---|---|
| 1403547 | 8/1975 | United Kingdom | 439/184 |

*Primary Examiner*—P. Austin Bradley

*Attorney, Agent, or Firm*—Willian, Brinks, Olds

[57] ABSTRACT

A high voltage, anti-corona connector defines similar interengaging structures of varying sizes which both retain the plug in the socket and provide substantially air-tight, anti-corona seals. The plug is a unitarily formed structure fabricated of a resilient dielectric material which defines an elongate contact receiving barrel having a plurality of spaced apart circumferential ribs of distinct sizes disposed on its outer surface. The socket includes a single contact disposed within a concentric aperture having at least one circumferential recess. One of the ribs of the plug seats within the socket recess and tightly retains the plug therein, the remaining ribs providing substantially air-tight seals to minimize arcing and corona discharge. Intimate seals between the face of the socket and a shoulder region of the plug adjacent the barrel as well as the end of the barrel and the internal end wall of the socket also contribute to the performance of the high voltage plug and socket of the present invention. The socket is adapted for panel mounting in enclosures for high voltage power supplies and in similar applications.

20 Claims, 2 Drawing Sheets

VIBRATION-PROOF PLUG AND SOCKET

This application is a continuation of application Ser. No. 101,684, filed Sept. 28, 1987, now abandoned.

BACKGROUND OF THE INVENTION

The invention relates generally to high voltage connectors and more specifically to high voltage single conductor plugs and sockets having cooperating and retaining ribs and recesses.

The requirements of high voltage connectors, especially for military applications, are both stringent and mutually exclusive. On the one hand, inasmuch as connectors are utilized in circuits operating at voltages of 10 kilovolts to 20 kilovolts and higher and are expected to exhibit extraordinary reliability, the obvious solution is to design large, heavy and durable connectors and housings. However, a typical and in fact frequent design parameter acknowledges the close quarters often encountered in installations and requires minimum package size. Another demands operation at high altitudes and correspondingly low atmospheric pressures. The existence of such conflicting design parameters requires understanding of the precise nature of a given interconnection application as well as ingenuity on behalf of the design engineer.

One early patent addressing the difficulties of connector integrity in high voltage circuits operating at reduced atmospheric pressure and/or high altitude is U.S. Pat. No. 2,448,509. Here, tapered and interengaging insulators are utilized about a single conductor. Another device using somewhat similar frusto-conical interengaging insulators is disclosed in U.S. Pat. No. 3,514,741.

More contemporary single conductor high voltage, anti-corona connectors which provide plural atmospheric seals or barriers between the current carrying contacts of the connector and the ambient are disclosed in U.S. Pat. Nos. 3,994,553 and 4,605,272.

High voltage connectors which are concerned with small package size are disclosed in U.S. Pat. Nos. 3,842,393 and 4,417,736.

A review of the foregoing patents, especially the latter two, reveals that while they apparently provide high voltage operating characteristics in small package sizes, the overall plug structure and retaining components occupy significant volume relative to the current carrying components. Therefore, improvements in the art of small high voltage connectors having commensurately small, sophisticated and well designed retention components are both desirable and possible.

SUMMARY OF THE INVENTION

The present invention relates to a high voltage, anti-corona connector of small size which exhibits excellent mechanical and electrical performance characteristics at operating voltages of from 10 to 25 kilovolts. The plug is a unitary structure preferably fabricated of a resilient dielectric material such as silicon rubber. The plug defines an elongate contact receiving cylinder or barrel extending from an enlarged concentrically disposed body portion. The elongate cylinder includes a plurality of spaced apart circumferential ribs of distinct sizes disposed on its outer surface.

The socket which is preferably formed of a non-resilient dielectric material such as diallyl phthalate includes a single contact disposed within a concentrically aligned aperture having at least one circumferential groove or recess. The larger of the ribs on the plug seats within the recess and the smaller ribs of the plug are compressed and seal tightly against the inner surface of the aperture. The larger rib tightly retains the plug within the socket, resisting mechanical shock and vibration, while the larger rib and the smaller ribs provide a plurality substantially air-tight seals to minimize arcing and corona discharge from the high voltage contacts within the plug and socket.

It is thus an object of the present invention to provide a high voltage, anti-corona single contact plug and socket.

It is a still further object of the present invention to provide a high voltage, anti-corona plug and socket wherein the plug includes a plurality of circumferential ribs and the socket includes at least one circumferential recess.

It is a still further object of the present invention to provide a high voltage, anti-corona connector including cooperating ribs and recesses which maintain the plug and socket in a mated condition.

Further objects and advantages of the present invention will become apparent by reference to the following description of the preferred embodiment and appended drawings.

DESCRIPTION OF THE PREFERRED AND ALTERNATE EMBODIMENTS

Figure 1:
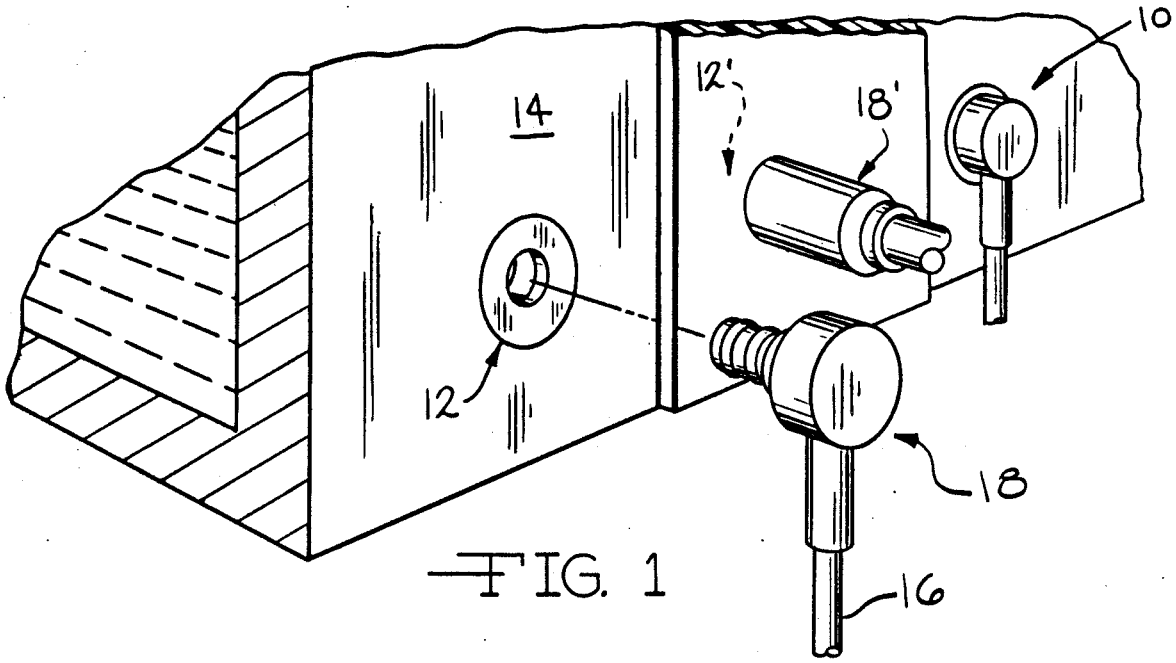
FIG. 1 is a fragmentary perspective view of vibration-proof plugs and sockets according to the present invention installed in an electronic component.

Referring now to FIG. 1, a preferred embodiment vibration-proof plug and socket assembly is illustrated and generally designated by the reference numeral 10. The plug and socket assembly 10 includes a female socket assembly 12 which is preferably configured for through panel mounting in an exterior wall 14 of a high voltage power supply or other component which either provides or utilizes high voltage electrical energy. Disposed upon the end of a high voltage conductor 16 is a right angle plug assembly 18. The plug assembly 18 includes components complementary to those contained in the socket assembly 12 and securely mates therewith. Also illustrated is a alternate embodiment straight plug assembly 18' which will be described in greater detail below with reference to FIG. 6.

Figure 2:
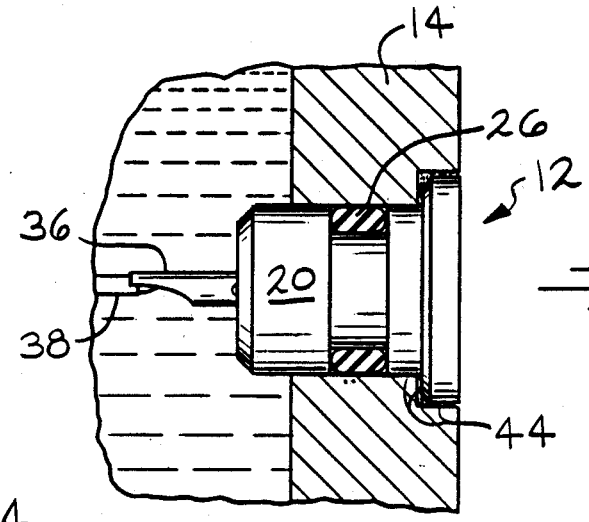
FIG. 2 is a fragmentary sectional view of a panel mounted socket according to the present invention.
Figure 3:
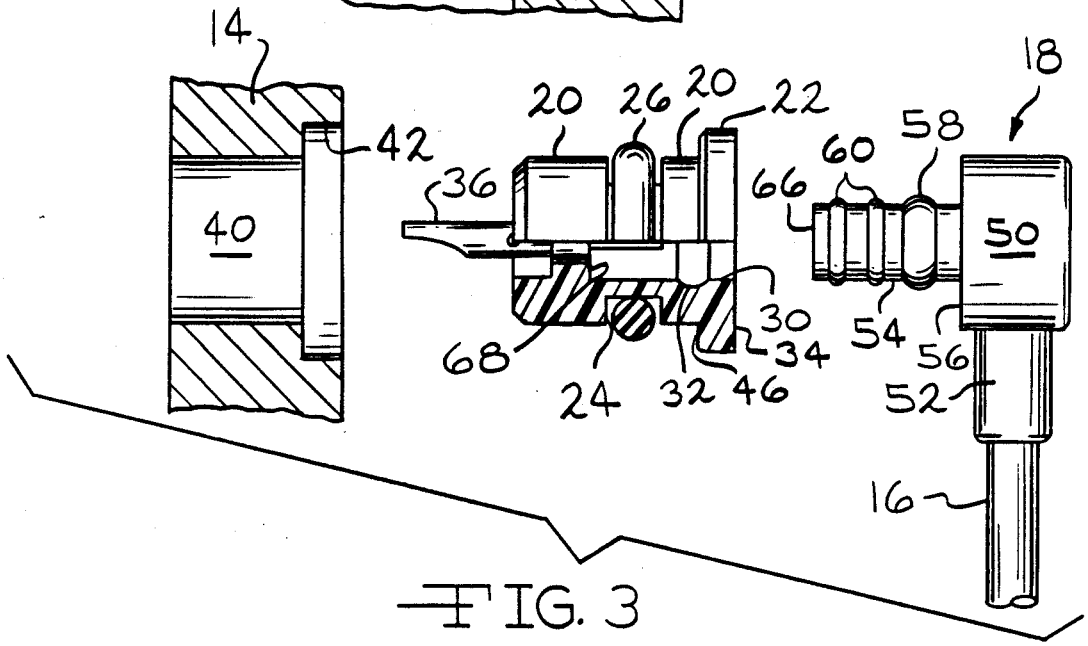
FIG. 3 is an exploded, side elevational view with portions in section of a plug and socket according to the present invention.
Figure 5:
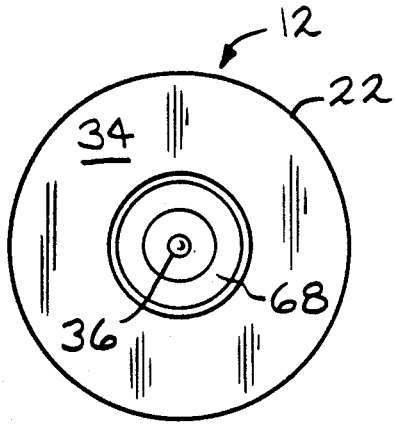
FIG. 5 is a front view of a socket according to the present invention.

Referring now to FIGS. 2, 3 and 5, the socket assembly 12 defines a generally elongate cylindrical body 20 having an enlarged diameter shoulder 22 at one end.

The elongate cylindrical body 20 of the socket assembly 12 is preferably fabricated of a diallyl phthalate or similarly rigid, non-resilient, electrically insulating and stable material. Axially spaced from the shoulder 22 and disposed generally medially along the length of the cylindrical body 20 is a re-entrant portion or circumferential channel 24. Received within the circumferential channel 24 is a resilient annulus or 0-ring seal 26. The 0-ring seal 26 is preferably fabricated of a silicon rubber or other suitable resilient, insulating and stable material.

The socket assembly 12 also defines a preferably circular blind aperture 30 which is concentrically disposed within the cylindrical body 20. A radially outwardly directed circumferential groove 32 is formed in the cylindrical wall of the blind aperture 30. The circumferential groove 32 may be shallow and arcuate or elliptical in cross section or deep and semi-circular in cross section and defines a width, i.e., diameter, if the channel is semi-circular, which is substantially smaller than (less than one half) the diameter of the aperture 30. The circumferential groove 32 is preferably positioned at least one half its own width (diameter) away from the outer or forward face 34 of the shoulder 22. Centrally disposed within the aperture 30 is a single axially oriented male electrical contact 36. The male electrical contact 36 is tightly retained within the cylindrical body 20 by appropriate adhesives or in-situ molding. The portion of the male contact 36 extending beyond the cylindrical body 20 may be suitably formed to securely receive by crimping or soldering the metallic conductors of an electrical lead 38.

As noted, the socket assembly 12 is intended for mounting in a structure such as a panel 14. A suitable opening defines an elongate through passageway 40 having an enlarged diameter shoulder region 42. The socket assembly 12 may be retained within the opening by the use of a suitable adhesive 44 disposed on and adjacent the rear face 46 of the enlarged diameter shoulder 22.

Figure 4:
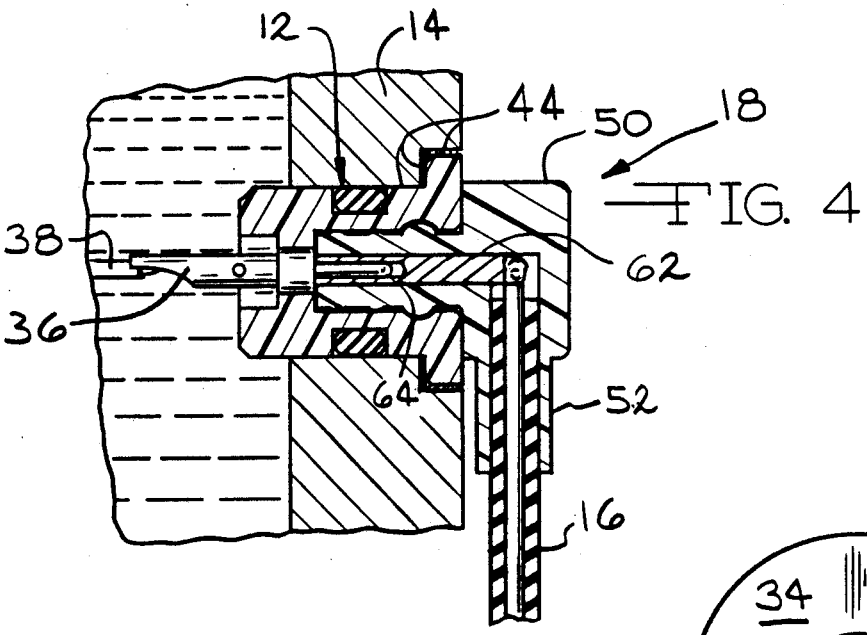
FIG. 4 is a fragmentary, full sectional view of a plug installed in a socket according to the present invention.

Referring now to FIGS. 3 and 4, the right angle plug assembly 18 is illustrated and is seen to generally define a one piece plug body 50 molded of a material such as silicon rubber or other similar resilient material having good dielectric characteristics which fully encapsulates the components of the plug assembly 18. The plug body 50 defines a cylindrical portion 52 which may extend radially from the plug body 50 and which minimizes bending of the conductor 16 adjacent the plug body 50 as well as reduces torque and strain on the electrical components of the plug assembly 18 as will be readily appreciated. The plug assembly 18 also includes an elongate cylindrical barrel 54 which defines a plurality of distinctly sized circumferential ribs. The diameter of the barrel 54 is no larger than and preferably slightly smaller than the diameter of the blind aperture 30. The length of the barrel 54 is substantially equal in length to the depth of the blind aperture 30. Extending radially outwardly from the junction of the body 50 and the barrel 54 is a shoulder or face 56.

The barrel 54 defines a large circumferential rib 58 adjacent the body 50 having a cross section complementary to the cross section of the groove 32. The large circumferential rib 58 may thus be arcuate, elliptical or semi-circular in cross section and has a width (diameter) smaller than the diameter of the barrel 54. The large rib 58 is preferably spaced along the barrel 54 a distance from the adjacent face 56 of plug body 50 equal to or slightly less than the distance between the groove 32 and the forward face 34 of the shoulder 22 of the socket assembly 12. Thus, the large rib 58 engages the groove 32 when the face 56 of the body 50 is seated against the face 34 of the shoulder 22 and retains the faces 34 and 56 in contact.

Disposed between the large circumferential rib 58 and the end of the barrel 54 is at least one and preferably a plurality of smaller circumferential ribs 60. The smaller circumferential ribs 60 are likewise preferably semi-circular in cross section and have a maximum outside diameter which is larger than the inside diameter of the blind aperture 30 in the socket assembly 12. The width or diameter of the smaller circumferential ribs 60 is about one half the corresponding dimension of the large circumferential rib 58. Concentrically disposed within the barrel 54 is a single female electrical contact 62 defining a centrally disposed blind circular aperture 64 which is complementary to and frictionally receives the male contact 36 of the socket assembly 12 thereby making and maintaining an electrical contact between the conductors 16 and 38. The female contact 62 may be electrically and mechanically secured to the conductor 16 by soldering or other suitable means prior to molding of the plug body 50 thereabout.

As illustrated in FIG. 4, the socket assembly 12 and plug assembly 18 intimately mate and maintain a positive high voltage connection between the connectors which is mechanically secure and substantially atmospherically airtight. Aspects of the electrical connection are conventional and will therefore not be further discussed.

With regard to the mechanical connection, it is achieved by cooperation, that is, seating, of the large circumferential rib 58 of the plug assembly 18 within the circumferential groove 32 within the socket assembly 12. When seated, the large circumferential rib 58 preferably fully fills the groove 32. The barrel 54 as well as the smaller ribs 60 and the cooperating electrical contacts 36 and 62 maintain the plug assembly 18 in an axially aligned orientation and inhibit skewing of the plug assembly 18 relative to the axis of the socket assembly 12 thereby augmenting the mechanical integrity of the connection.

Separate atmospheric, anti-corona seals are provided by each of the smaller circumferential ribs 60 sealingly engaging the inner wall of the blind aperture 30 thereby defining a plurality of sealed annular volumes of air. Finally, the end face 66 of the barrel 54 engages and seals against a complementary circular end face 68 within the blind aperture 30 of the socket assembly 12. Such multiple seals effectively inhibit corona discharge and arcing between the voltage carrying components of the present invention and the atmosphere.

Figure 6:
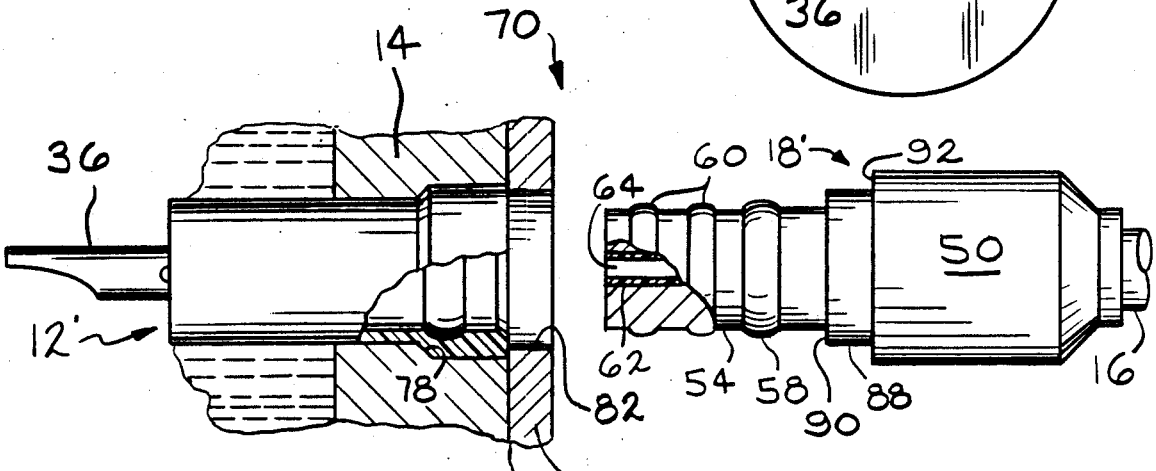
FIG. 6 is a side elevational view in partial section of an alternate embodiment vibration-proof plug and socket according to the present invention with portions broken away.
Figure 7:
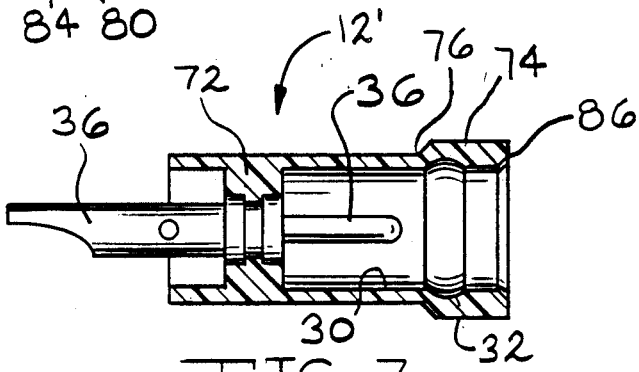
FIG. 7 is a full, sectional view of an alternate embodiment vibration proof socket according to the present invention.

Referring now to FIGS. 6 and 7, an alternate embodiment plug and socket assembly 70 is illustrated and includes an alternate embodiment plug assembly 18' and an alternate embodiment socket assembly 12'. The socket assembly 12' defines an elongate body 72 having an enlarged end region 74. An intermediate shoulder region 76 may be utilized to assist retention of the socket assembly 70 within a panel by cooperating with a complementary shoulder 78 in the panel 14 as will be readily appreciated. The alternate embodiment socket assembly 12' may be retained in position by a faceplate 80 having an aperture 82 of smaller diameter than the outside diameter of the end region 74 of the socket assembly 12'. The aperture 82 must, however, have a diameter at least as large as the diameter of the large circumferential rib 58 on the barrel 54 of the plug assembly 18' in order to permit insertion of the plug assembly 18'. The faceplate 80 may be secured to the wall 14 by an adhesive 84 or other suitable fastening means such as rivets, threaded fasteners and the like. The socket assembly 12' is preferably fabricated of a rigid, dielectric, stable material such as diallyl phthalate.

The socket assembly 12' defines an interior blind aperture 30 which is identical in all respects to the preferred embodiment blind aperture 30. As such, it also includes a circumferential groove 32. The circumferential groove 32 may be semi-circular in cross section although other cross sections which are complementary to the cross section of the large rib 58 on the barrel 54 of the plug assembly 18' may be utilized. Preferably, the circumferential groove 32 is disposed at a distance approximately equal to its width from the open end of the aperture 30. Either molded in-situ or secured by suitable means such as an adhesive within the alternate embodiment socket assembly 12' is a concentrically disposed male contact 36. The male contact 36 includes a channel or aperture which facilitates the soldering or crimping of a conductor (not illustrated) thereto. The socket assembly 12' also includes a narrow circular face 86 which encircles the aperture 30.

The alternate embodiment plug 18' is identical to the preferred embodiment plug 18 in all but one respect and that is that the high voltage conductor 16 exits the plug body 50 axially rather than at a right angle as it does in the preferred embodiment plug 18. Thus the axial alternate embodiment plug 18' also includes the elongate cylindrical barrel 54, a large circumferential rib 58, one or more smaller circumferential ribs 60 and a concentrically disposed female electrical contact 62 defining an aperture 64. The plug assembly 18' also includes an intermediate cylindrical region 88 which extends axially a distance equal to the thickness of the faceplate 80 and has a diameter slightly smaller than the diameter of the aperture in the faceplate 80. At the end of the cylindrical region 88 proximate the large circumferential rib 58 is a radially extending face 90 which seats against the circular face 86 of the socket assembly 12'. Likewise, at the end of the cylindrical region 88 proximate the body 50 is a larger radially extending face 92 which seats against the faceplate 80.

It will be appreciated and understood that the alternate embodiment plug and socket assembly 70 functions in a manner identical to that of the preferred embodiment plug and socket assembly 10, providing the same vibration-proof retention of the plug assembly 18' within the socket assembly 12' and the same multiple anti-corona seals. It should further be understood and appreciated that inasmuch as the differences between the preferred and alternate embodiments of the socket assemblies 12 and 12' and the plug assemblies 18 and 18' are primarily structural and unrelated to the seals and interengaging electrical components, the preferred embodiment socket assemblies 12 may generally be utilized with alternate embodiment plug assemblies 18' and vice versa. Furthermore, the mounting arrangement, i.e., the faceplate 80, of the alternate embodiment socket assembly 12 may be readily utilized with the preferred embodiment socket assembly 12. Clearly, the plug assembly, either of the preferred embodiment 18 or the alternate embodiment 18', must include the intermediate cylindrical region 88 if the mating socket assembly 12 or 12' is secured by the faceplate 80 for reasons readily understood.

The foregoing disclosure is the best mode devised by the inventors for practicing this invention. It is apparent, however, that apparatus incorporating modifications and variations will be obvious to one skilled in the art of electrical connectors. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

We claim:

1. In a single conductor high voltage electrical connector, the improvement comprising:

a socket having a circular blind aperture defined by an inner wall and an inwardly extending face at one end of said aperture, a radially outwardly extending face at the other end of said aperture, a circumferential recess in said inner wall disposed an axial distance from said face at the other end of said aperture and an electrical contact disposed in the center of said blind aperture, and a plug having a circular barrel, a body defining a face radially outwardly extending from said barrel, an electrical contact disposed in the center of said barrel, retaining means for mechanically securing said plug in said socket including a larger rib disposed on said barrel having a cross section substantially complementary to the cross section of said recess and disposed said axial distance from said face extending from said barrel and seal means for providing an anti-corona seal including at least one smaller rib disposed on said barrel between said larger rib and the end of said barrel.

2. The improvement of claim 1 wherein said barrel and said blind aperture are substantially equal length.

3. The improvement of claim 1 wherein said larger rib and said recess are elliptical in cross section and the outside diameter of said larger rib is substantially equal to the inside diameter of said recess.

4. The improvement of claim 1 wherein said larger rib and said recess are arcuate in cross section and the outside diameter of said larger rib is substantially equal to the inside diameter of said recess.

5. The improvement of claim 1 wherein said larger rib and said recess are semi-circular in cross section and the outside diameter of said larger rib is substantially equal to the inside diameter of said recess.

6. The improvement of claim 1 wherein said larger rib is semi-circular in cross section and has a width substantially smaller than the diameter of said barrel.

7. The improvement of claim 1 wherein said radially outwardly extending face of said socket is in contact with said radially outwardly extending face of said plug when said plug and socket are mated.

8. The improvement of claim 1 wherein said radially inwardly extending face of said blind aperture is in contact with the end of said barrel when said plug and said socket are mated.

9. The improvement of claim 1 wherein said socket is fabricated of a rigid dielectric material and said plug is fabricated of a resilient dielectric material.

10. The improvement of claim 1 further including a second smaller rib disposed on said barrel.

11. A high voltage, single conductor electrical connector assembly comprising, in combination, a socket having a circular blind aperture defined by an inner wall, a radially outwardly extending face at one end of said wall and an inwardly extending face at the other end of said wall, a circumferential recess in said wall disposed an axial distance from said face at the other end of said aperture and an electrical contact extending through the center of said inwardly extending face, and a plug having a circular barrel, a body defining a radially outwardly extending face adjacent said barrel, an electrical contact disposed concentrically within said barrel, retaining means for mechanically securing said plug in said socket including a first rib disposed on said barrel having a cross section substantially complementary to the cross section of said circumferential recess and disposed said axial distance from said face extending from said barrel and seal means for providing an anti-corona seal including a pair of smaller ribs disposed on said barrel between said larger rib and the end of said barrel.

12. The connector assembly of claim 11 further including an additional smaller rib on said barrel.

13. The connector assembly of claim 11 wherein said smaller rib has an outside diameter at least as large as the diameter of said blind aperture.

14. The connector assembly of claim 11 wherein said first rib and said recess are elliptical in cross section and the outside diameter of said first rib is substantially equal to the inside diameter of said recess.

15. The connector assembly of claim 11 wherein said first rib and said recess are arcuate in cross section and the outside diameter of said first rib is substantially equal to the inside diameter of said recess.

16. The connector assembly of claim 11 wherein said first rib and said recess are semi-circular in cross section and the outside diameter of said first rib is substantially equal to the inside diameter of said recess.

17. The connector assembly of claim 11 wherein said barrel and said blind aperture are substantially equal in length.

18. The connector assembly of claim 11 wherein said circumferential recess is axially displaced from said radially outwardly extending face a distance at least equal to the distance between said first rib and said radially outwardly extending face of said plug body.

19. The connector assembly of claim 11 wherein one of said smaller ribs defines an isolated volume of air adjacent the end of said barrel and the other of said smaller ribs defines an isolated volume of air adjacent said one of said smaller ribs.

20. A high voltage, single conductor electrical connector assembly comprising, in combination, a socket fabricated of a rigid dielectric material having a blind circular aperture defining an inner wall, a radially outwardly extending face at one end of said wall and an inwardly extending face at the other end of said wall, a circumferential recess disposed in said wall an axial distance from said radially outwardly extending face and an electrical contact extending through the center of said inwardly extending face, and a plug fabricated of a resilient dielectric material having a body, a circular barrel extending from said body and defining an end face, a radially outwardly extending face defined by said body adjacent said barrel, an electrical contact disposed concentrically within said barrel, retaining means for mechanically securing said plug in said socket including a first rib disposed on said barrel having a cross section substantially complementary to the cross section of said circumferential recess and disposed said axial distance from said radially outwardly extending face defined by said body and seal means for providing an anti-corona seal including a pair of ribs smaller than said first rib disposed on said barrel between said end face and said first rib, wherein said first rib is sealingly disposed in said circumferential recess, said pair of ribs sealingly engage said inner wall, said end face of said barrel sealingly engages said radially inwardly extending face of said socket and said radially outwardly extending face of said body sealingly engages said radially outwardly extending face of said socket when said plug is assembled to said socket.

* * * * *